US008544489B2

(12) United States Patent
Choi

(10) Patent No.: US 8,544,489 B2
(45) Date of Patent: Oct. 1, 2013

(54) COLLAPSIBLE TENT FRAME WITH RETRACTABLE EAVES

(75) Inventor: Kwan Jun Choi, Fujian (CN)

(73) Assignee: Ki Ho Jin, Xiamen (CN)

( * ) Notice: Subject to any disclaimer, the term of this patent is extended or adjusted under 35 U.S.C. 154(b) by 224 days.

(21) Appl. No.: 12/799,269

(22) Filed: Apr. 20, 2010

(65) Prior Publication Data

US 2011/0073148 A1 Mar. 31, 2011

(30) Foreign Application Priority Data

Sep. 29, 2009 (CN) ..... 2009 2 0183292 U

(51) Int. Cl.
*E04H 15/50* (2006.01)
*E04H 15/46* (2006.01)

(52) U.S. Cl.
USPC ..... 135/145; 135/140; 135/147; 135/151

(58) Field of Classification Search
USPC ..... 135/122, 139, 140, 141, 142, 143, 135/144, 145, 147, 151, 146
See application file for complete search history.

(56) References Cited

U.S. PATENT DOCUMENTS

| | | | | |
|---|---|---|---|---|
| 1,720,132 | A | 7/1929 | Kuhn | |
| 1,846,011 | A | 2/1932 | Adams | |
| 3,621,857 | A | 11/1971 | May et al. | |
| 4,506,688 | A * | 3/1985 | Bethoon et al. | 135/140 |
| 5,035,253 | A | 7/1991 | Bortles | |
| 5,638,853 | A | 6/1997 | Tsai | |
| 6,283,136 | B1 | 9/2001 | Chen | |
| 6,718,995 | B2 | 4/2004 | Dotterweich | |
| 6,848,461 | B2 * | 2/2005 | Tsai | 135/131 |
| 7,055,538 | B2 | 6/2006 | Deng | |
| 7,182,092 | B1 | 2/2007 | Cantwell | |
| 7,299,812 | B2 | 11/2007 | Carter | |
| 7,367,348 | B2 | 5/2008 | Tsai et al. | |
| 2002/0092555 | A1 | 7/2002 | Chen et al. | |
| 2002/0108647 | A1 | 8/2002 | Chen et al. | |
| 2006/0174929 | A1 | 8/2006 | Tseng | |
| 2006/0260666 | A1 | 11/2006 | Choi | |
| 2007/0051397 | A1 | 3/2007 | Choi | |
| 2007/0084491 | A1 | 4/2007 | Dalbo | |
| 2007/0221262 | A1 | 9/2007 | Tsai et al. | |
| 2009/0314323 | A1 * | 12/2009 | Park et al. | 135/145 |
| 2010/0043856 | A1 * | 2/2010 | Park et al. | 135/145 |
| 2010/0275962 | A1 * | 11/2010 | Park et al. | 135/122 |

* cited by examiner

*Primary Examiner* — David Dunn
*Assistant Examiner* — Danielle Jackson
(74) *Attorney, Agent, or Firm* — John H. Choi

(57) ABSTRACT

A collapsible tent structure includes a plurality of poles coupled with a plurality of linkages. The tent structure also includes a plurality of rods where each rod is pivotally coupled to each pole on one end and pivotally coupled to a hub on an opposite end. A plurality of struts are further included in the tent structure and each strut is pivotally coupled to each rod on one end and pivotally coupled to each pole on an opposite end, and a locking mechanism is coupled to each of the rods. A plurality of eaves, each pivotally coupled to a locking mechanism, extend radially outward beyond the poles when in an extended position and retracted radially inward of the poles when in a retracted position while the tent is in an open configuration.

13 Claims, 11 Drawing Sheets

PRIOR ART

PRIOR ART

COLLAPSIBLE TENT FRAME WITH RETRACTABLE EAVES

BACKGROUND OF THE INVENTION

1. Field of Invention

The present invention relates to a folding tent, and more specifically, to an eave structure of a tent frame.

2. Description of the Related Art

Tents are made in various structural forms. Small and mid-sized tents are typically used for camping and are fabricated with lightweight materials for easy transport. Alternatively, larger pavilion-like folding tents are often used for outdoor sun-shading and include sturdy construction to withstand various weather conditions (e.g., wind, rain, etc.).

As shown in FIG. 1, a traditional pavilion-like tent, known in the prior art, is constructed in such a way that a roof stand 2' is supported by four poles 1' and overlaid with a cover cloth 3'. The sun-shading area of the tent is the roof area formed by exterior boundaries of the cover cloth 3' that is supported by the respective poles 1'. If a user demands a relatively large sun-shading area, he or she has to prolong the respective supporting bars 21' of the roof stand 2', and add cooperatively several auxiliary supporting bars to secure the supporting strength for the roof of the unfolded tent. However, as a result of this, the height of the entire tent after folded is increased.

Therefore, in order to increase the sun-shading area of the unfolded tent without increasing the height of the folded tent, as known in the prior art and shown in FIGS. 2A and 2B, a tent with an eave was developed, wherein outside a respective pole 1', an cave bracket 4' is arranged and comprises an eave main bar 41' and an eave subsidiary bar 42', the eave main bar 41' having one end pivotally attached to a fixed seat 11' at the top end of the pole 1', and the other end connected to an exterior boundary of the cover cloth; the eave subsidiary bar 42' having one end pivotally attached to a sliding block 43' and slidingly disposed on the pole 1', and the other end pivotally attached to the eave main bar 41'. The eave stand 4' is expanded and closed synchronically with the roof stand 2', in such a way that the sun-shading area of the tent is efficiently enlarged, without increasing the length of the entire tent after folded.

However, the above-mentioned eave stand consists of two supporting bars, and meanwhile sliding blocks are required to be arranged on the poles additionally, so that the tent after folded has a comparatively increased volume. In addition, if one end of the eave subsidiary bar is directly attached pivotally to the sliding block of the roof stand, the eave subsidiary bar is necessarily configured in such a relatively long length for assuring a successful folding of the tent that does not satisfy practical requirements. Also, it is not possible for the user to retract the eaves when the user wishes not to use them.

To solve this problem, the applicant of the current patent application constructed an eave structure which is pivotable from a retracted to an extended position even while the tent was open. The eave is locked in the extended position with a clip by friction. This construction is more fully described in Publication No. US 2007/0051397. Even though the eaves are retractable, the eaves were not sufficiently secured by the clips and had a tendency to unlock due to external forces such as heavy wind. Thus, a retractable eave structure with a more reliable locking system was needed.

SUMMARY OF THE INVENTION

It is an object of the present invention to provide an eave structure of a tent, which is simply structured and firmly supports the eave, without increasing the volume of the tent after it is folded. Another object of the present invention is to provide an eave structure that is easily separately retractable so that the user has the option to use or not use the eave structure while the tent is open. Yet another object of the present invention is to provide an eave structure that can be reliably maintained in an extended configuration without collapsing.

To achieve the above mentioned objects, the present invention provides a collapsible tent frame configured to receive a canopy comprising a plurality of vertically directed poles, each pole having a fixed connector coupled to an upper portion of the vertically directed pole and a sliding connector slidingly coupled to the pole beneath the fixed connector. Each of the fixed connectors and sliding connectors have a pair of radially spaced connecting seats and a center connecting seat between the pair of radially spaced connecting seats. Each fixed connector further comprises a top portion. A plurality of scissor-type linkages are pivotally coupled to each pole at the radially spaced connecting seats of the fixed connectors and the sliding connectors. The collapsible tent also includes a plurality of rods having first and second segments, the first rod segment of each rod pivotally coupled to the center connecting seat of the fixed connector. A hub is pivotally coupled to the second segment of each rod and defines the center of the tent. The first and second rod segments are pivotally coupled by an intermediate pivot connecting member. The tent includes a plurality of struts having first and second ends, the first end of each strut pivotally coupled to the center connecting seat of the sliding connector, the second end of each strut pivotally connected to each first rod segment. The tent also includes a plurality of eaves each having first and second ends. The first end of the eave is pivotally coupled to the locking mechanism and the second end of the eave extends radially outward beyond the poles and is supported by the top portion of the fixed connector when the eave is locked by the locking mechanism in an extended position. The second end of the eave is also retractable radially inward of the poles in a retracted position when the tent is in the open configuration.

In another embodiment, the tent includes a plurality of eaves each having first and second ends. Each eave has a smaller cross-sectional area than the rods and the first end of the eave is slidingly coupled within the first rod segment. The second end of the eave is slidingly extended radially outward beyond the poles and locked by the locking mechanism in an extended position and is slidingly retracted radially inward of the poles and locked by the locking mechanism in a retracted position while the tent is in the open configuration.

PREFERRED EMBODIMENTS FOR CARRYING OUT THE INVENTION

Figure 1:
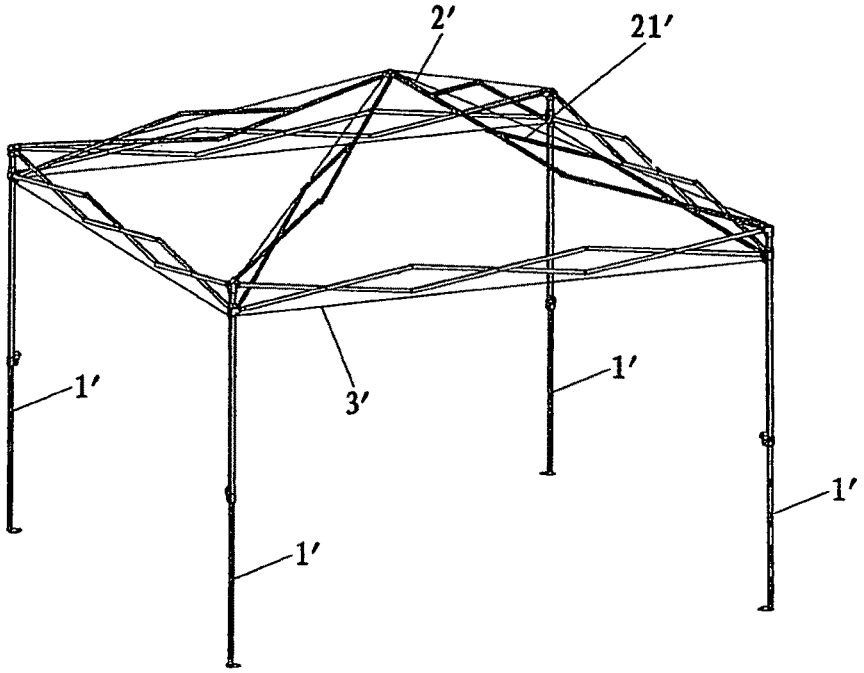
FIG. 1 is a perspective view of a prior art tent.
Figure 2A:
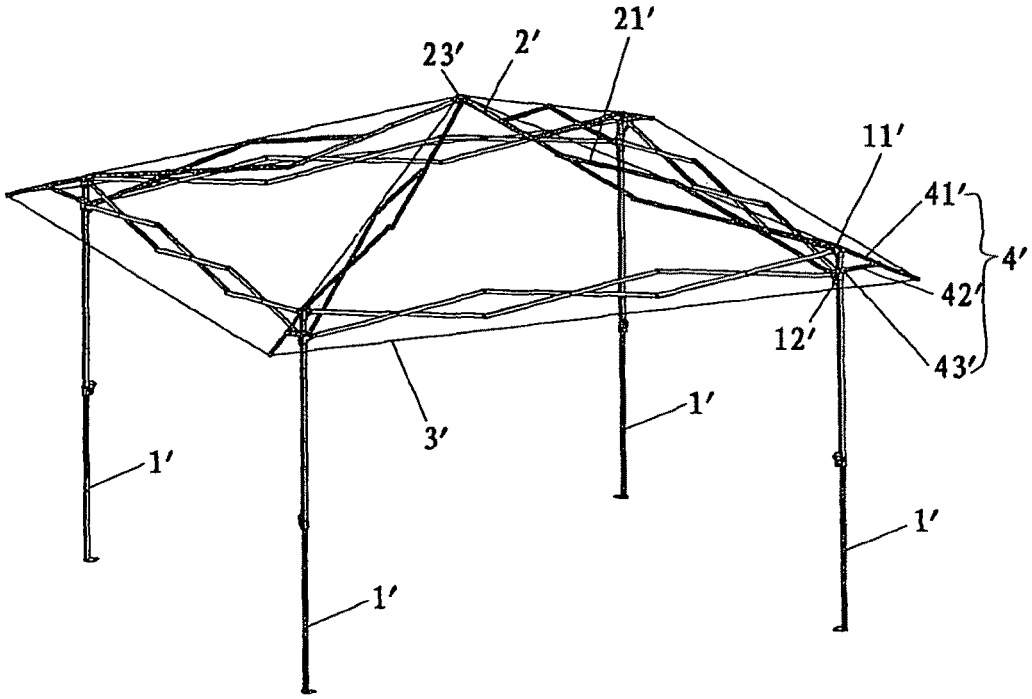
FIG. 2A is a perspective view of another prior art tent.
Figure 2B:
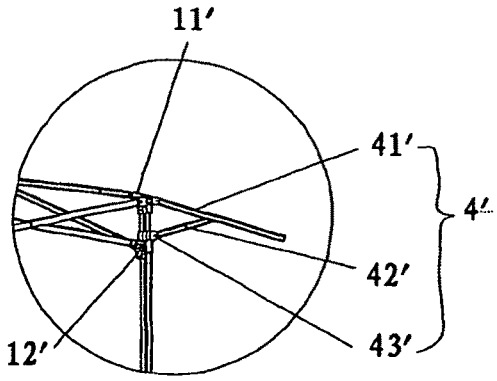
FIG. 2B is a partial perspective view of the prior art tent shown in FIG. 2A.
Figure 3:
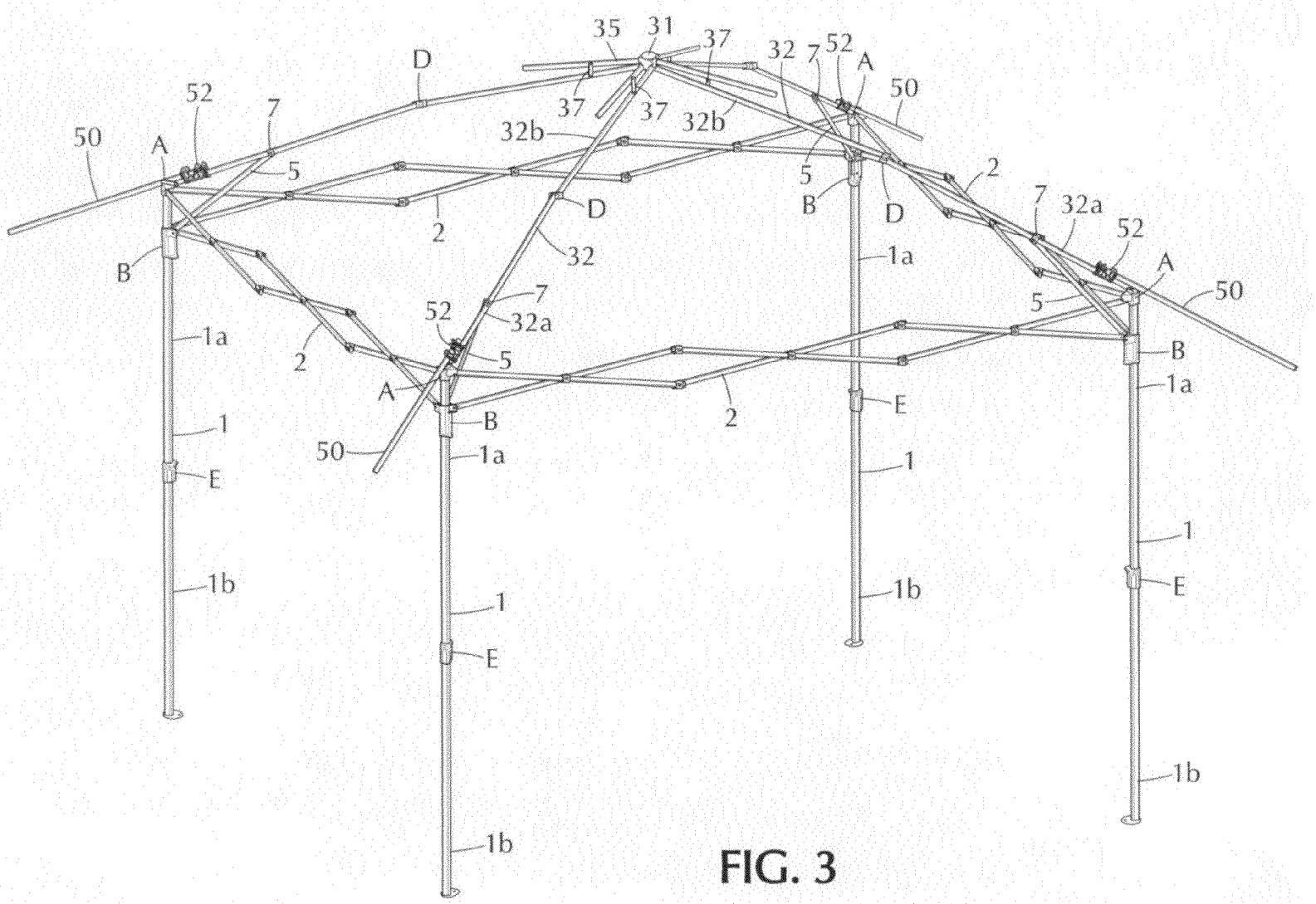
FIG. 3 is a perspective view of the tent frame of the first embodiment of the present invention.
Figure 6:
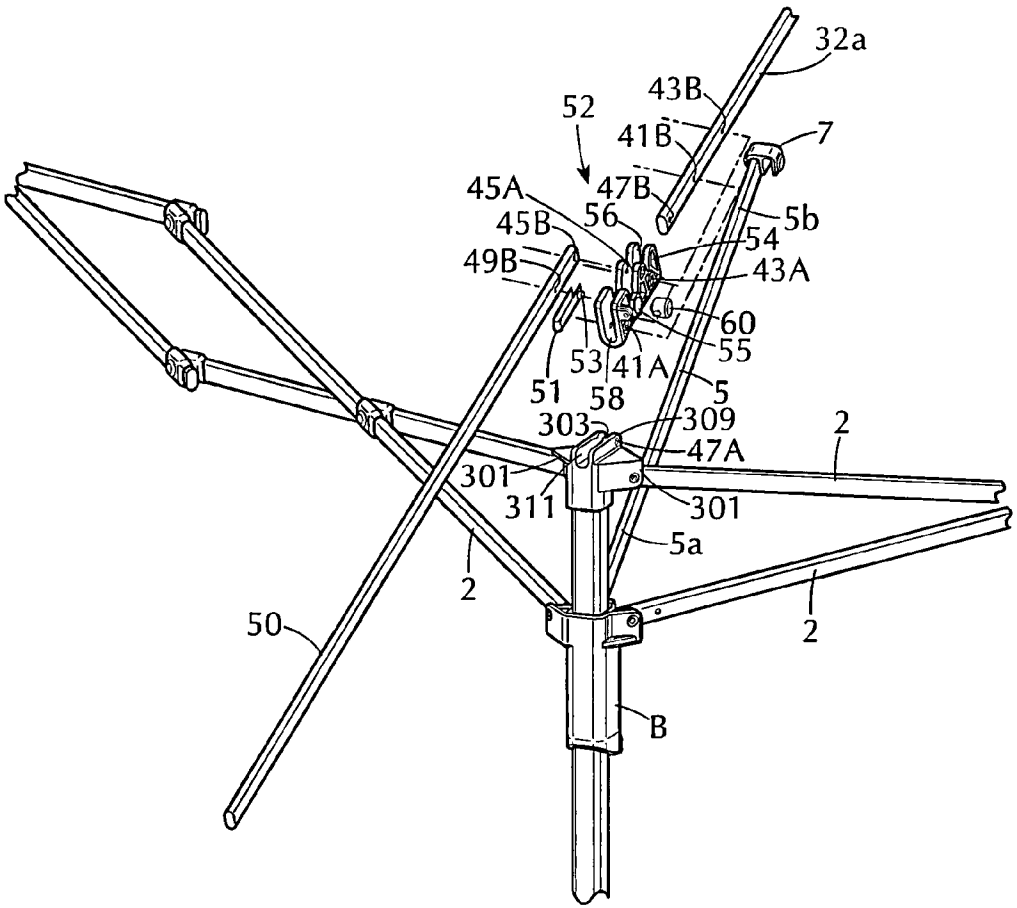
FIG. 6 is an exploded view of FIG. 5.
Figure 7:
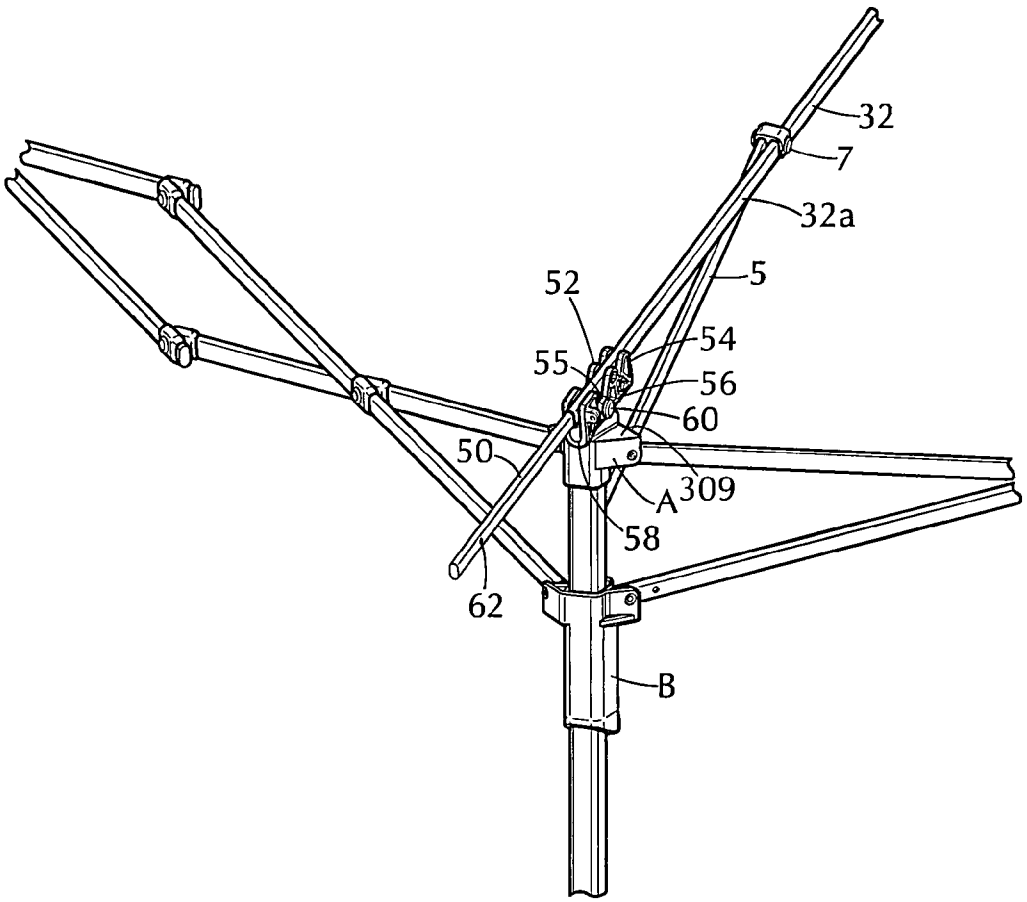
FIG. 7 is a perspective view of the tent frame of a second embodiment of the present invention.
Figure 8:
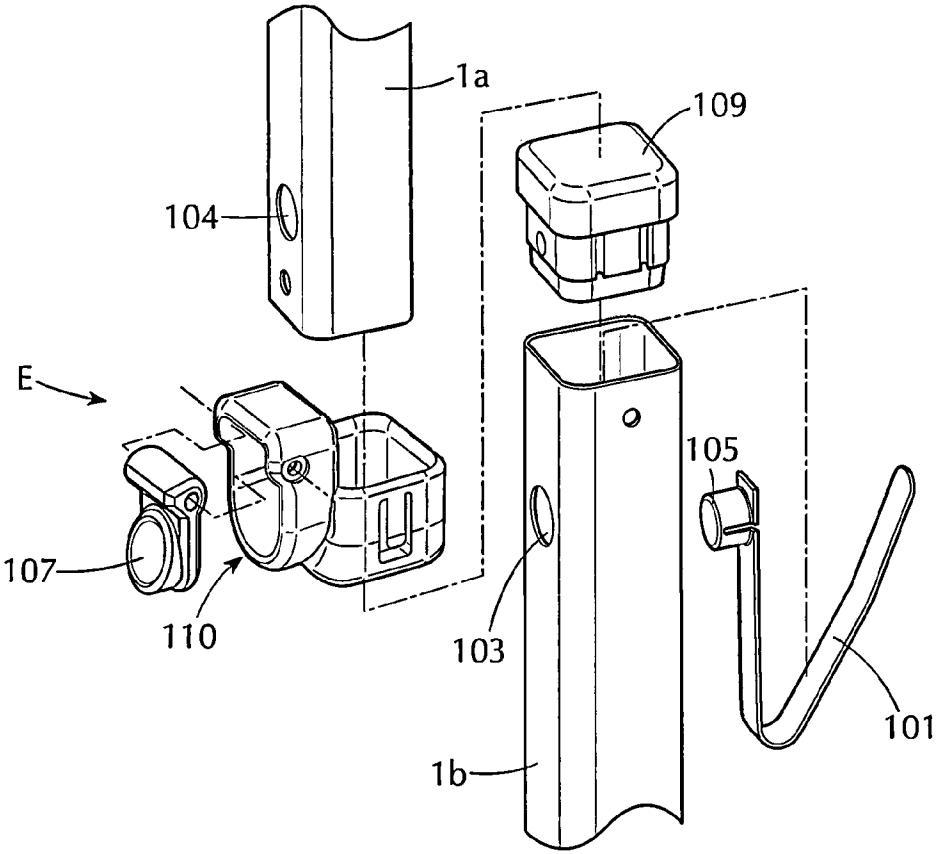
FIG. 8 is an exploded view of a locking mechanism of the present invention.

As shown in FIGS. 3-11, the collapsible tent frame of the present invention is a "one-touch" structure capable of opening and closing without additional assembly or disassembly. Referring to FIG. 3, the tent includes four vertically directed poles 1 constructed of an upper portion 1*a* and a lower portion 1*b*. The lower portion 1*b* is sized such that it slides in and out of the upper portion 1*a*, i.e., telescoping, and both upper and lower portions 1*a*, 1*b* can be "locked" at one or more height positions. Referring to FIGS. 3 and 8, the lower portion of the pole 1*b* includes a hole 103 which corresponds to a hole 104 of the upper portion 1*a*. A locking mechanism E is coupled to the pole 1 and comprises a spring 101 having an extension 105 which extends through the lower portion hole 103. The spring 101 is further secured within the lower portion 1*b* with a cap 109. A mount 110 having a pushbutton 107 is attached to the pole upper portion 1*a* and the button 107 is aligned with the upper portion hole 104. When the holes 103, 104 are aligned, the spring 101 causes the extension 105 to extend through both holes 103, 104 thereby locking the upper and lower portions 1*a*, 1*b* in an extended position as shown, for example, in FIG. 3. To release the upper and lower portions 1*a*, 1*b*, the pushbutton 107 is pressed inwardly, thereby disengaging the extension 105 from the upper portion hole 104.

Figure 4:
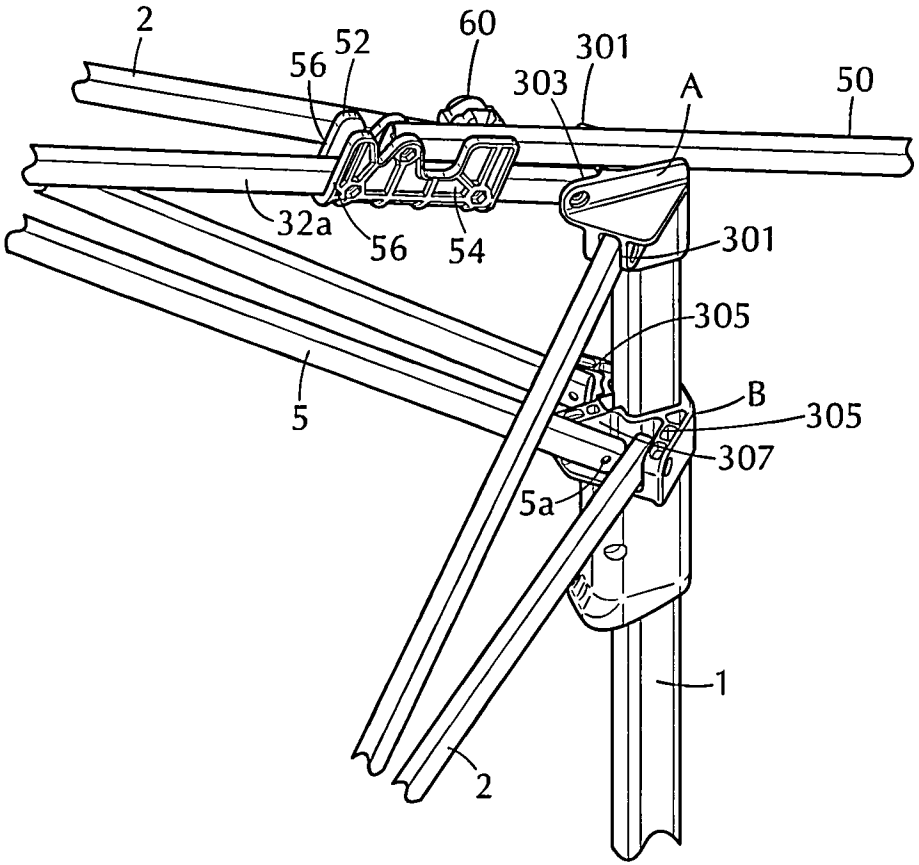
FIG. 4 is a partial perspective view of the tent frame shown in FIG. 3.

Referring to FIGS. 3 and 4, the upper portion 1*a* of the pole 1 has four fixed connectors "A" respectively coupled to the upper portion 1*a* of each of the vertically directed poles 1. Each of the fixed connectors A has a pair of radially spaced connecting seats 301 and a center connecting seat 303 disposed between the pair of radially spaced connecting seats 301. The tent also includes four sliding connectors "B" slidingly coupled to each of the four vertically directed poles 1 at the upper portion 1*a* and below the fixed connector A. Referring to FIG. 6, the fixed connector A includes a top portion 309 and, in the preferred embodiment, includes a groove 311. The top portion 309 also includes a pair of opposing apertures 47A.

Referring to FIG. 4, each sliding connector B has a pair of radially spaced connecting seats 305 formed thereon and a center connecting seat 307 disposed between the pair of radially spaced connecting seats 305. Four scissors-type linkages 2 are pivotally coupled to each of the four vertically directed poles 1 via the fixed connector radially spaced connecting seats 301 and the sliding connector radially spaced connecting seats 305 as shown in FIGS. 4 and 6.

Figure 9:
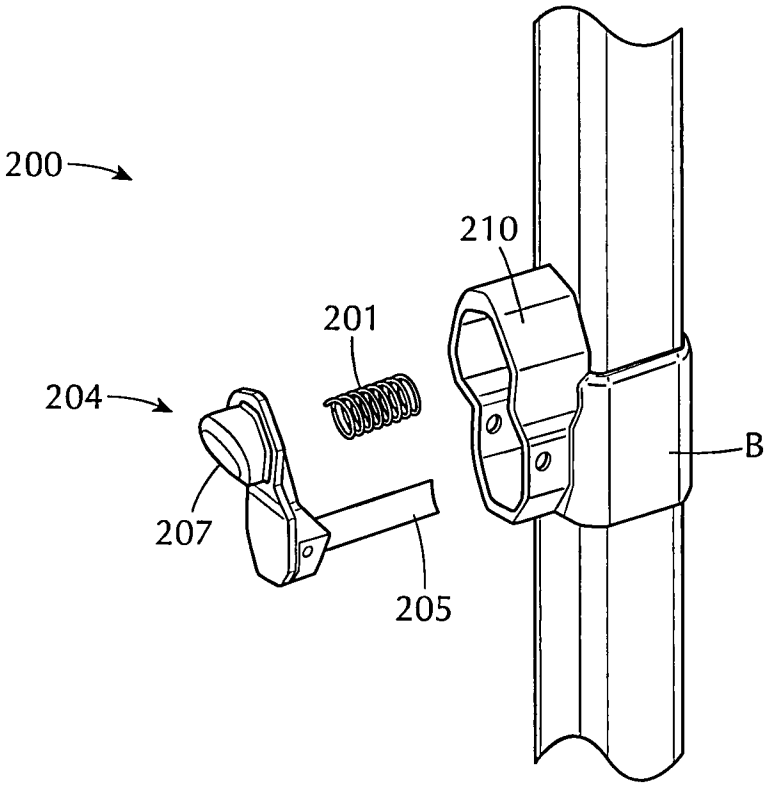
FIG. 9 is an exploded view of another locking mechanism of the present invention.

Referring to FIGS. 3 and 9, each sliding connector B also has a locking mechanism 200 for locking the sliding connectors B in the tent or canopy's open configuration. In one embodiment, the sliding connector locking mechanism 200 includes a mount 210 integral to the sliding connector B and a lever 204 pivotally fixed and enclosed to the mount 210. The lever 204 includes an outward facing button 207 on one end of the lever and an extension directed inwardly towards the pole 1 on the lever 204. A torsion spring 201 biases the button 207 away from the pole 1 and the extension 205 towards the pole 1. The pole 1 includes an aperture (not shown) sized to receive the extension 205. When the sliding connector B is positioned over the aperture, the free end of the extension 205 is biased through the aperture to lock the sliding connector B in position. That is, the sliding connector B is locked in the tent frame's open position when the extension 205 engages the aperture of the pole 1.

Referring again to FIG. 3, the tent includes four rods 32 having first and second segments 32*a*, 32*b*. One end of the first rod segment 32*a* is pivotally coupled to the four vertically directed poles 1 at the center connecting seat 303 of the fixed connector A. The first and second rod segments 32*a*, 32*b* are pivotally coupled via an intermediate pivot connecting member D.

Referring to FIGS. 3-6, the tent also includes struts 5 having first and second ends 5*a*, 5*b*. The strut first end 5*a* is pivotally coupled to the center connecting seat 307 of the sliding connector B and the second end 5*b* of the strut 5 is pivotally coupled to the rod 32 via strut connector 7 for further support of the overall structure.

Preferably, all connections in the preferred embodiment are screw-type fasteners. These fasteners may have additional components such as washers and ball bearings to reduce friction between the connecting members of the tent.

Figure 10:
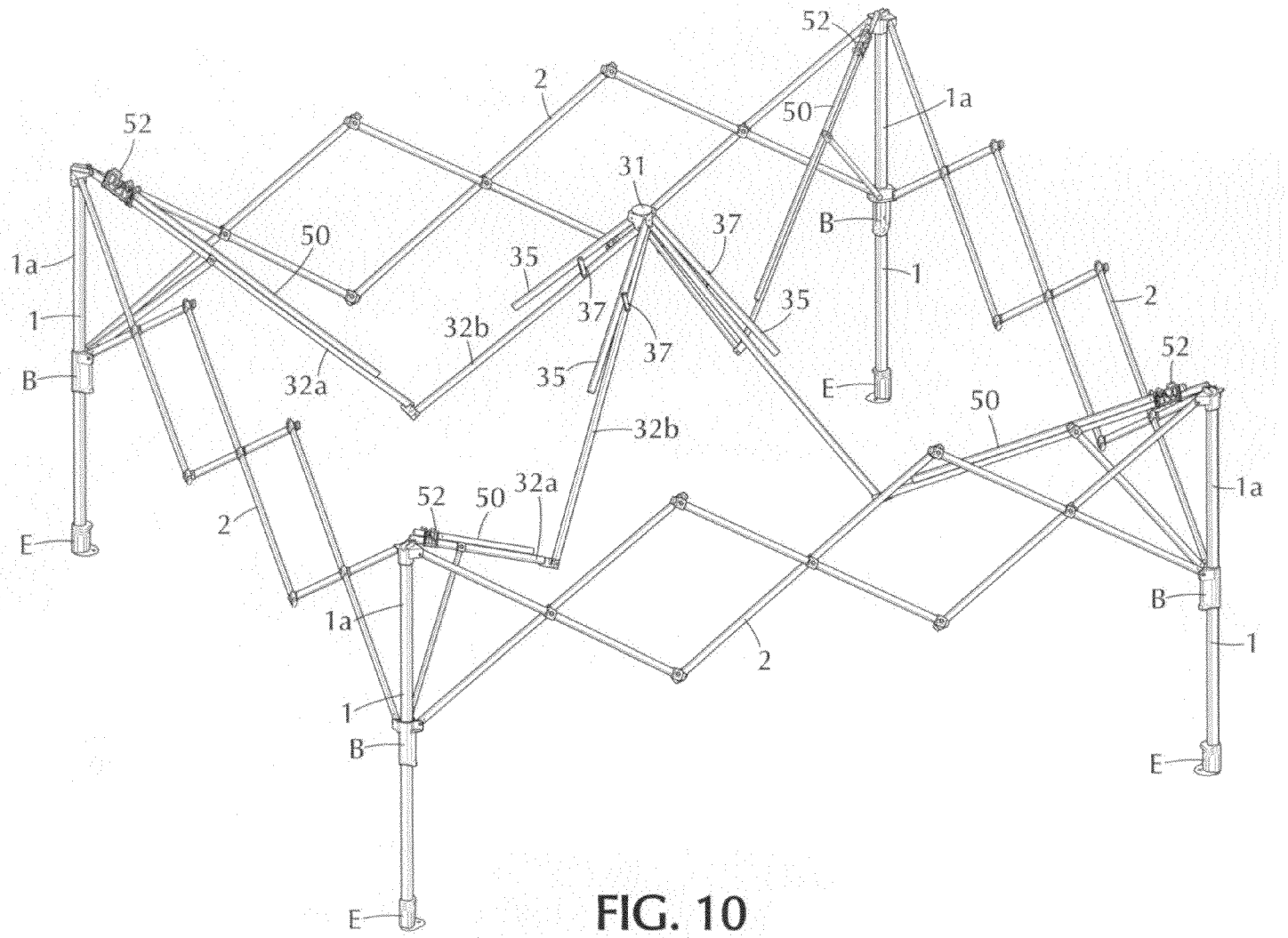
FIG. 10 is a perspective view of the tent frame shown in FIG. 3 in a partially closed configuration.

Referring to FIG. 3, a hub 31 is pivotally coupled to the distal end of each of the second segments 32*b* of each of the four rods 32. The tent also includes auxiliary rods 35 which are pivotally coupled with the hub 31. Each auxiliary rod 35 is further coupled with each of the second rod segment 32 via braces 37, as shown in FIG. 10. The auxiliary rods 35 provide an additional ventilation structure, which is more fully described in U.S. Patent Application Publication No. 2006/0260666 and is incorporated herein by reference in its entirety.

As shown in FIGS. 3-6, the tent also includes eaves 50, each of which are pivotally coupled with a locking mechanism 52. Referring to FIGS. 4 and 6, the locking mechanism 52 is similar to the pole locking mechanism E described above. The eave locking mechanism 52 includes a base 54 having opposing side walls 56 and a bottom surface 58 (FIG. 6). A pushbutton 60 extends through the side wall 56 and engages a pushbutton aperture 55 via a spring (not shown).

Figure 5:
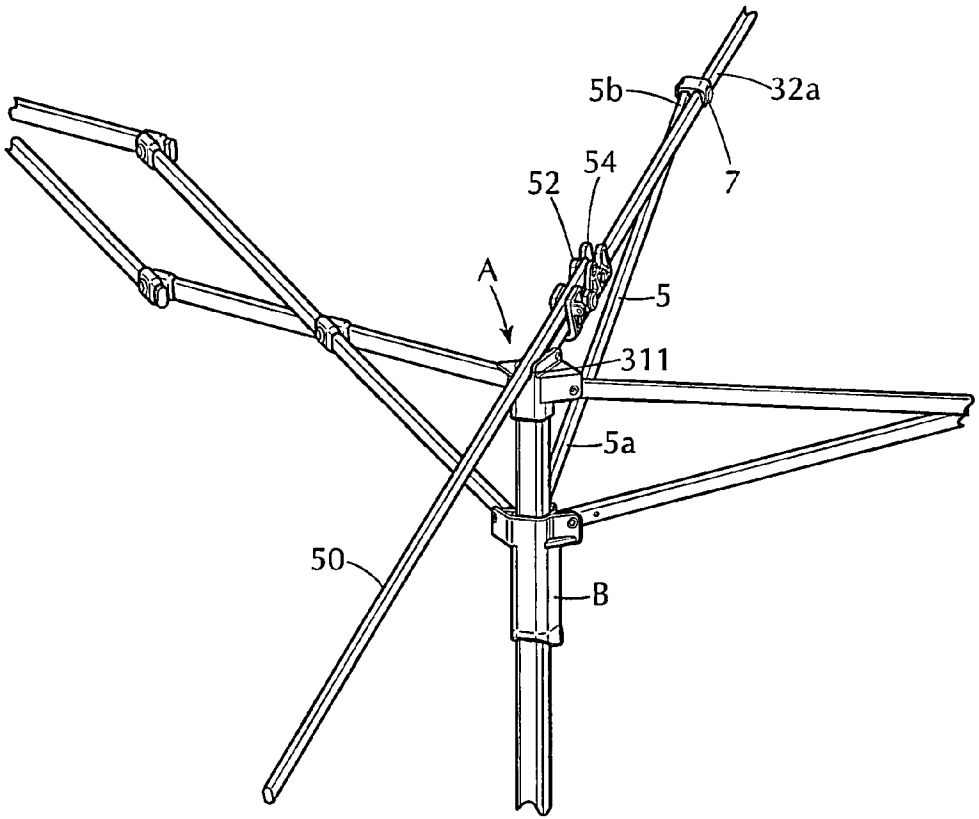
FIG. 5 is a partial perspective view of the tent frame shown in FIG. 3.

Each side wall 56 also includes three opposing pairs of apertures 41A, 43A, 45A. The first rod segment 32*a* includes apertures 41B, 43B and 47B which correspond to apertures 41A, 43A and 47A, respectively. As shown in FIG. 5, the first rod segment 32*a* is located within and pivotally coupled with the eave base 54 with fasteners extending through the corresponding paired apertures 41A/41B; 43A/43B; and 47A/47B. Referring to FIG. 6, the eave 50 includes two opposing pairs of apertures 45B and 49B. A spring 51 having an extension 53 is positioned within the hollow interior of the eave 50 and the extension 53 extends through the aperture 49B. As shown in FIGS. 5 and 6, the eave 50 is pivotally coupled with the base 54 by fastener through apertures 45A and 45B. In an extended position, the spring extension 53 extends through and engages the pushbutton aperture 55. This allows for the eave 50 to lock into place in an extended position. The eave 50 is further secured in its extended position by the groove 311. The eave 50 is retracted to its retracted position (FIG. 10) by depressing the pushbutton 60 and disengaging the spring extension 53. Although not contemplated in the preferred embodiment, the eave base 54 can include additional apertures and the eave 50 can include an additional spring extension such that the eave 50 can be locked in its retracted position as well.

Referring to FIG. 7, in a second embodiment, the cross-sectional area of the eave 50 is less than the cross-sectional area of the rod 32 such that the eave 50 telescopes within the rod 32. The eave locking mechanism 52 is coupled with the fixed connector top portion 309 and includes a base 54 having opposing side walls 56 and a bottom surface 58. The pushbutton 60 includes an extension (not shown) which engages and extends through a pushbutton aperture 55 on the side wall 56. In the preferred embodiment, this is accomplished with a compression spring (not shown) positioned between the pushbutton 60 and side wall 56. The eave 50 includes two apertures 62 corresponding to the pushbutton 60 extension. In an extended position, the pushbutton extension engages the eave aperture (not shown) at the proximal end of the eave. In a retracted position, the pushbutton 60 extension engages the eave aperture 62 located at the distal end of the eave 50. Alternatively, telescoping can be accomplished using a spring and extension within the eave 50 for engaging the pushbutton 60 coupled to a torsion spring as in the first embodiment.

The cross-sections of the main components of the tent, i.e., the poles 1, scissor-type linkages 2, rods 32, struts 5 and eaves 50, can also have different configurations. Aside from the traditional circular cross-sections used for tent structures, other cross-section shapes, such as square, rectangular or oval cross-sections can be used and accomplish the above mentioned objectives.

Figure 11:
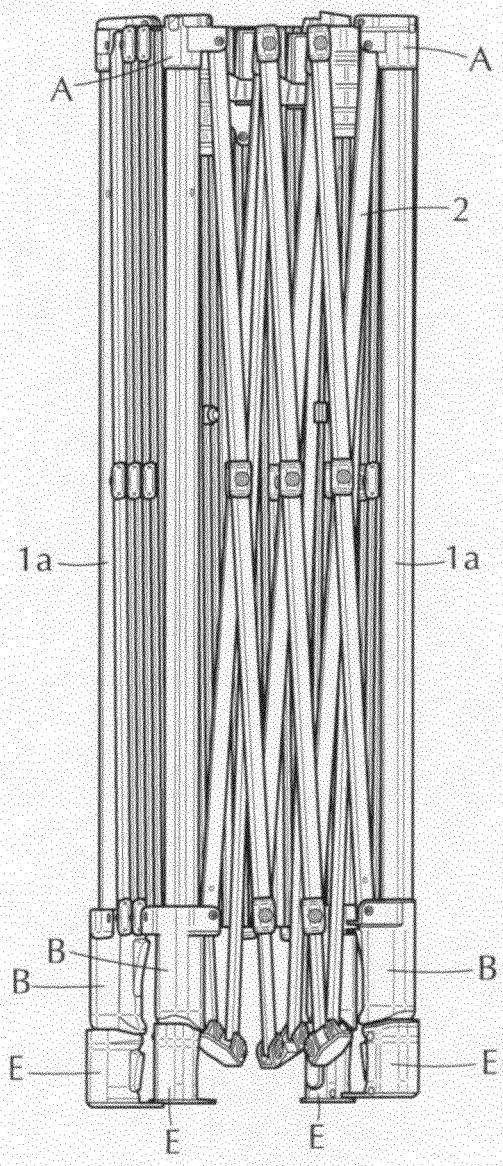
FIG. 11 is a perspective view of the tent frame shown in FIG. 3 in a fully closed configuration.

Referring to FIGS. 3, 10 and 11, in operation, the tent is opened by pulling the poles 1 radially outward such that the rods 32 and scissor-type linkages 2 are extended. The pole lower portions 1*b* are extended and locked by the locking mechanism E. The eaves 50 are pivotally rotated outward and locked by the eave locking mechanism 52 holding the tent in its open configuration.

Referring to FIGS. 10 and 11, the tent is folded by unlocking the pole lower portions 1*b* and pushing them within the pole upper portions 1*a*. The eaves 50 are unlocked and retracted and the poles 1 are pushed radially inward such that the rods 32 and scissor-type linkages 2 are folded to its closed configuration.

A canopy is used with the tent structure. The canopy can be integrated with the structure such that the canopy is permanently attached to the tent structure in both the open and closed configurations. The canopy can also be separately assembled and disassembled.

Thus, the present invention includes a retractable eave structure with a reliable locking system. The present invention also makes possible for the user to retract the eaves while the tent is in use.

Although an exemplary description of the invention has been set forth above to enable those of ordinary skill in the art to make and use the invention, that description should not be construed to limit the invention, and various modifications and variations can be made to the description without departing from the scope of the invention, as will be understood by those with ordinary skill in the art, and the scope thereof is determined by the claims that follow.

What is claimed is:

1. A tent frame configured to receive a canopy and being collapsible from an open configuration to a closed configuration, the tent frame comprising:

a plurality of vertically directed poles, each pole having a fixed connector coupled to an upper portion of the vertically directed pole and a sliding connector slidingly coupled to the pole beneath the fixed connector, each of the fixed connectors and sliding connectors having a pair of radially spaced connecting seats and a center connecting seat positioned between the pair of radially spaced connecting seats, each fixed connector further comprising a top portion;

a plurality of scissor-type linkages pivotally coupled to each pole at the radially spaced connecting seats of the fixed connectors and the sliding connectors;

a plurality of rods, each rod having first and second segments, the first segment of each rod having an end portion pivotally coupled to the center connecting seat of the fixed connector;

a hub defining the center of the tent, the second segment of each rod pivotally coupled to the hub;

a plurality of struts having first and second ends, the first end of each strut pivotally coupled to the center connecting seat of the sliding connector, the second end of each strut pivotally connected to each first rod segment, a plurality of locking mechanisms, each one of which being directly attached to a corresponding one of the first rod segments distally from said end portion thereof; and a plurality of eaves each having first and second sections, the first section of each eave having a locking portion and an end portion, the end portion being pivotally coupled to a pivot point of a corresponding one of said plurality of locking mechanisms, said end portion and locking portion of each eave being positioned inwardly and distally from said end portion of the corresponding one of the first rod segments in an extended position and a retracted position;

wherein in the extended position, the locking portion of the first section of each eave is engaged with and fixedly retained by a corresponding one of the plurality of locking mechanisms to prevent rotational movement of the eave about the pivot point, said first section of each eave extending outwardly from the pivot point and being positioned and locked substantially parallel to a corresponding one of the elongated rods, and the second section of each eave extends radially outward beyond the poles such that each eave is seated on and supported by the top portion of a corresponding one of the plurality of fixed connectors at a location between the first and second sections of each eave; and wherein in the retracted position, the second section of each eave is pivotally rotated about the pivot point and positioned to extend radially inward with respect to the poles, said first section of each eave extending inwardly from the pivot point and being positioned substantially parallel to the corresponding one of the elongated rods.

2. The collapsible tent frame of claim 1, wherein the top portion of each fixed connector comprises a groove integrally formed thereto, the groove extending through an outer corner of the top portion of the fixed connector and configured to receive a corresponding eave when in the extended position such that the eave is positioned therein substantially parallel to a corresponding adjacent rod.

3. The collapsible tent frame of claim 1, wherein the hub comprises auxiliary rods coupled to the rods.

4. The collapsible tent frame of claim 1, wherein each one of the plurality of locking mechanisms comprises a sidewall having an aperture formed therethrough and a pushbutton corresponding to and engaging the aperture.

5. The collapsible tent frame of claim 4, wherein the eave further comprises a spring extension for engaging the aperture when the eave is in the extended position.

6. A tent frame configured to receive a canopy and being collapsible from an open configuration to a closed configuration, the tent frame comprising:

a plurality of poles coupled with a plurality of linkages;

a plurality of rods, each rod having a longitudinal axis and pivotally coupled to a corresponding one of the plurality of poles on an outer end and pivotally coupled to a hub on an inner end, wherein the hub defines a central axis of the frame;

a plurality of locking mechanisms, each of the locking mechanisms having opposing sidewalls and at least one of the opposing sidewalls including a pivot portion and a locking portion, each of the plurality of locking mechanisms fixedly attached to a corresponding one of the plurality of rods; and a plurality of eaves, each of which having an end being pivotably coupled to the pivot portion of a corresponding one of the plurality of locking mechanisms such that each eave is independently extendable and retractable, said pivot portion and locking portion of each locking mechanism being positioned inwardly along the longitudinal axis and distally from said outer end of the corresponding one of the plurality of rods;

wherein in an extended position each eave extends radially outward beyond the poles from the pivot portion of the locking mechanism, and a first portion of each eave is fixedly secured substantially parallel to a corresponding one of the rods by the locking portion of the corresponding one of the plurality of locking mechanisms to prevent rotation thereof, and in a retracted position each eave is pivotally retracted radially inward of the poles and retained substantially parallel to the corresponding one of the rods by the corresponding one of the plurality of locking mechanisms.

7. The collapsible tent frame in claim 6, wherein each locking mechanism comprises an aperture formed in one of the opposing sidewalls and a pushbutton corresponding to and engaging the aperture.

8. The collapsible tent frame in claim 7, wherein the eave further comprises a tubular portion having a spring including an extension, said spring being positioned within the tubular portion such that the spring extension is positioned for engaging the aperture when the eave is in the extended position.

9. The collapsible tent frame in claim 8, wherein each eave comprises an orifice formed through the tubular portion and aligned with a corresponding pushbutton and aperture of one of the plurality of locking members for permitting selective engagement of the spring extension by the pushbutton in the extended and retracted positions.

10. The collapsible tent frame in claim 6, wherein the hub comprises auxiliary rods coupled to the rods.

11. The collapsible tent frame in claim 6, wherein each locking mechanism further comprises a base formed between the opposing sidewalls to form a U-shaped locking mechanism.

12. The collapsible tent frame of claim 6, wherein a top portion of each pole comprises a groove integrally formed thereto for receiving a corresponding eave when in the extended position, the groove extending through an outer corner of the top portion of the pole such that the eave is positioned therein substantially parallel to a corresponding adjacent rod.

13. A tent frame configured to receive a canopy and being collapsible from an open configuration to a closed configuration, the tent frame comprising:

a plurality of vertically directed poles, each pole having a fixed connector coupled to an upper portion of the vertically directed pole and a sliding connector slidingly coupled to the pole beneath the fixed connector, each of the fixed connectors and sliding connectors having a pair of radially spaced connecting seats, a top portion of each fixed connector comprising a groove integrally formed thereto, the groove extending through an outer corner of the top portion of the fixed connector;

a plurality of scissor-type linkages pivotally coupled to each pole at the radially spaced connecting seats of the fixed connectors and the sliding connectors;

a plurality of rods, each rod having first and second segments, the first segment of each rod having an end portion pivotally coupled to a center portion of the fixed connector;

a hub defining the center of the tent, the second segment of each rod pivotally coupled to the hub;

a plurality of locking mechanisms, each one of which being directly attached to a corresponding one of the first rod segments distally from said end portion thereof; and a plurality of eaves each having first and second sections, the first section of each eave having a locking portion and an end portion, the end portion being pivotally coupled to a pivot point of a corresponding one of said plurality of locking mechanisms, said end portion and locking portion of each eave being positioned inwardly and distally from said end portion of the corresponding one of the first rod segments in an extended position and a retracted position;

wherein in the extended position, the locking portion of the first section of each eave is engaged with and fixedly retained by a corresponding one of the plurality of locking mechanisms to prevent rotational movement of the eave about the pivot point, said first section of each eave extending outwardly from the pivot point and being positioned and locked substantially parallel to a corresponding one of the elongated rods, and the second section of each eave extends radially outward beyond the poles such that each eave is seated on and supported by the groove of a corresponding one of the plurality of fixed connectors at a location between the first and second sections of each eave; and wherein in the retracted position, the second section of each eave is pivotally rotated about the pivot point and positioned to extend radially inward with respect to the poles, said first section of each eave extending inwardly from the pivot point and being positioned substantially parallel to the corresponding one of the elongated rods.

* * * * *